US011363361B2

(12) United States Patent
Sakai

(10) Patent No.: US 11,363,361 B2
(45) Date of Patent: Jun. 14, 2022

(54) VARIABLE MICROPHONE SHELTER, SOUND COLLECTION SYSTEM, SOUND COLLECTION METHOD, AND PROGRAM

(71) Applicant: Sony Corporation, Tokyo (JP)

(72) Inventor: Yusuke Sakai, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 17/162,081

(22) Filed: Jan. 29, 2021

(65) Prior Publication Data

US 2021/0243512 A1 Aug. 5, 2021

(30) Foreign Application Priority Data

Jan. 31, 2020 (JP) ..... JP2020-015035

(51) Int. Cl.
*H04R 1/08* (2006.01)
*H04R 1/04* (2006.01)
*H04R 3/04* (2006.01)

(52) U.S. Cl.
CPC ..... *H04R 1/086* (2013.01); *H04R 1/04* (2013.01); *H04R 3/04* (2013.01); *H04R 2410/07* (2013.01)

(58) Field of Classification Search
USPC ..... 381/189, 359
See application file for complete search history.

(56) References Cited

U.S. PATENT DOCUMENTS 6,160,896 A * 12/2000 Macaluso ..... H04M 1/03 381/386
9,386,133 B2 * 7/2016 Chang ..... H04W 4/90
2009/0279712 A1 * 11/2009 Gollbach ..... H04R 1/086 381/71.6
2017/0289664 A1 * 10/2017 St Clair ..... H04R 1/326

FOREIGN PATENT DOCUMENTS

JP 03-003899 U 1/1991

* cited by examiner

*Primary Examiner* — James K Mooney
(74) *Attorney, Agent, or Firm* — Oblon, McClelland, Maier & Neustadt, L.L.P.

(57) ABSTRACT

A sound collection system includes a sound collection unit, a variable shelter configured to cover the sound collection unit, an optimum form determination unit configured to determine a form of the variable shelter on a basis of an ambient environmental state, and a shelter optimization control unit configured to change the form of the variable shelter on a basis of a determination result by the optimum form determination unit.

16 Claims, 3 Drawing Sheets

VARIABLE MICROPHONE SHELTER, SOUND COLLECTION SYSTEM, SOUND COLLECTION METHOD, AND PROGRAM

CROSS REFERENCE TO RELATED APPLICATIONS

This application claims the benefit of Japanese Priority Patent Application JP 2020-015035 filed on Jan. 31, 2020, the entire contents of which are incorporated herein by reference.

TECHNICAL FIELD

The present technology relates to a variable microphone shelter, a sound collection system, a sound collection method, and a program, and especially relates to a variable microphone shelter, a sound collection system, a sound collection method, and a program that enable high-quality sound collection even in an outdoor environment.

BACKGROUND ART

Telepresence systems have been developed, which connect distant spaces by videos and sounds and the like to enable a person to feel as if those places are connected and the other person exists in the same space.

Such a telepresence system has a microphone installed at a certain base and collects an ambient sound, for example, and transmits a sound signal obtained by the sound collection to another base.

Furthermore, the microphone can be used not only for collecting a sound but also for measuring wind speed, vibration characteristics, and the like.

For example, as such a technology, a technology for reducing wind noise by arranging a large-diameter sub-noise coaxially in front of a main noise in a sensor microphone that measures characteristics related to noise and vibration of a pipeline such as a wind tunnel has been proposed (see, for example, PTL 1).

CITATION LIST

Patent Literature

[PTL 1]
JP 3-3899 Y

SUMMARY

Technical Problem

However, there is a difficulty in performing high-quality sound collection in an outdoor environment by the above-described technology.

For example, current general microphones are mainly intended to collect conversational voices and music performances in a stable indoor environment that is not affected by wind or rain.

However, in a telepresence device that constantly connects indoors and outdoors, or outdoors, there is a difficulty in using a general microphone from the viewpoint of weather resistance and sound quality such as wind noise.

For example, it has been possible to record a sound outdoors by a professional sound collector by adjusting a gain and a sound collection method while using a wind screen (wind cover), a waterproof cover, or the like, but this is only temporary. Therefore, if the microphone is left outdoors for a long period of time, the microphone is not able to perform sufficient sound collection in terms of both performance and sound quality.

Furthermore, for example, waterproof microphones that can handle typhoon relays and long-term outdoor sound collection have also been put into practical use, but pursuing confidentiality tends to deteriorate sound quality such as muffled sound, and conversely, pursuing sound quality tends to impair confidentiality and weather resistance.

The present technology has been made in view of such a situation, and enables high-quality sound collection even in the outdoor environment.

Solution to Problem

A sound collection system according to the first aspect of the present technology includes a sound collection unit, a variable shelter configured to cover the sound collection unit, an optimum form determination unit configured to determine a form of the variable shelter on the basis of an ambient environmental state, and a shelter optimization control unit configured to change the form of the variable shelter on the basis of a determination result by the optimum form determination unit.

A sound collection method or a program according to the first aspect of the present technology is a sound collection method by a sound collection system including a sound collection unit, and a variable shelter that covers the sound collection unit, or a program, the sound collection method or the program including determining a form of the variable shelter on the basis of an ambient environmental state, and changing the form of the variable shelter on the basis of a determination result of the form of the variable shelter.

In the first aspect of the present technology, in the sound collection system including the sound collection unit and the variable shelter that covers the sound collection unit, the form of the variable shelter is determined on the basis of an ambient environmental state, and the form of the variable shelter is changed on the basis of a determination result of the form of the variable shelter.

A variable microphone shelter according to a second aspect of the present technology includes a plurality of shelters, in which the shelters that cover a sound collection unit are switched such that the sound collection unit is covered with one or a plurality of the shelters of the plurality of the shelters according to an ambient environmental state.

In the second aspect of the present technology, the variable microphone shelter includes the plurality of shelters, and the shelters that cover the sound collection unit are switched such that the sound collection unit is covered with one or a plurality of the shelters of the plurality of the shelters according to the ambient environmental state.

DESCRIPTION OF EMBODIMENTS

Figure 1:
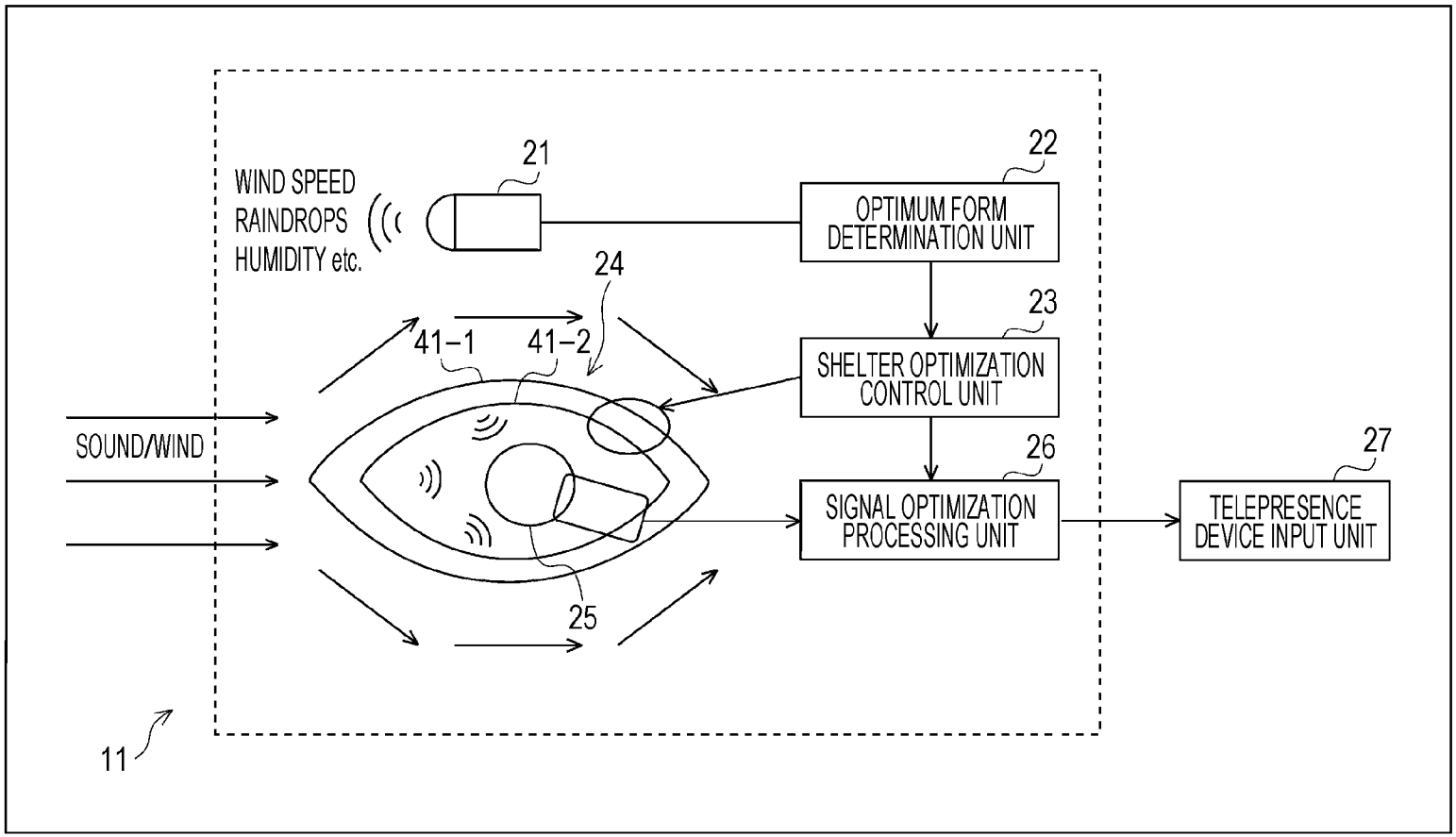
FIG. 1 is a diagram illustrating a configuration example of a sound collection system.

Hereinafter, embodiments to which the present technology is applied will be described with reference to the drawings.

First Embodiment

Configuration Example of Sound Collection System

The present technology relates to a structure of a variable microphone shelter having weather resistance and wind resistance and capable of performing high-quality sound collection in an outdoor environment on a constant basis, a sound collection method, and a wind speed measurement method.

The variable microphone shelter of an embodiment of the present technology has a weather-resistant and wind-resistant structure that is robust against natural phenomena such as rain, wind, and dust when a microphone is installed in an outdoor environment.

With the structure, for example, a telepresence system that connects outdoors and indoors, or outdoors on a constant basis can convey presence of people and an atmosphere of an environment in a connected space with stable high-quality sound while having weather resistance.

Furthermore, according to an embodiment of the present technology, for example, in a microphone sound collection scene for measuring an environmental sound and a sound field outdoors, a sound collection method and a wind speed measurement method can be implemented, in which a microphone shield structure capable of performing high-quality sound collection while suppressing wind noise and a material are combined.

In particular, the variable microphone shelter of an embodiment of the present technology has a layering structure like a tent, and can be changed to an optimum state (form) according to the wind speed or the like. The above technology can be applied to, for example, acoustic equipment, field recording, fixed-point observation, outdoor image capture, and the like. Hereinafter, a case in which the present technology is applied to a telepresence system will be described as a specific example.

For example, the telepresence system according to an embodiment of the present technology includes telepresence devices installed at a plurality of different bases, and the telepresence systems are connected to one another via a network.

Each base where the telepresence system is installed is considered to be an outdoor environment such as a camping place or an indoor environment such as an office building.

Furthermore, in the telepresence system, videos and sounds are transmitted and received between the telepresence devices, and the videos and sounds at the mutual bases are shared.

That is, for example, a video and a sound captured and collected at a certain base of a predetermined telepresence device are transmitted to a telepresence device at another base via the network, and the received video and sound are played back in the destination telepresence device. As a result, users at bases can experience telepresence.

Furthermore, each base of the telepresence system is provided with a capture system that captures an ambient video at the base and a sound collection system that collects an ambient sound, and the video obtained by the capture system and the sound obtained by the sound collection system are supplied to the telepresence device.

For example, a sound collection system installed in a base of a telepresence system and which collects an ambient sound is configured as illustrated in FIG. 1.

A sound collection system 11 illustrated in FIG. 1 is installed in an outdoor or indoor environment, which is a base of a telepresence system, for example.

The sound collection system 11 includes an environment sensor 21, an optimum form determination unit 22, a shelter optimization control unit 23, a variable microphone shelter 24, a microphone capsule 25, a signal optimization processing unit 26, and a telepresence device input unit 27.

Furthermore, the variable microphone shelter 24 is provided with a plurality of microphone shelters including a microphone shelter 41-1 and a microphone shelter 41-2 as microphone shelters that function as covers for covering the microphone capsule 25.

In particular, in this example, the outside of the microphone capsule 25 is covered with the microphone shelter 41-2, and the outside of the microphone shelter 41-2 is covered with the microphone shelter 41-1. That is, the microphone capsule 25 is covered in layers with the microphone shelter 41-1 and the microphone shelter 41-2.

Note that, hereinafter, in a case where it is not necessary to distinguish the microphone shelters provided in the variable microphone shelter 24 such as the microphone shelter 41-1 and the microphone shelter 41-2, they are simply referred to as microphone shelter(s) 41. The environment sensor 21 performs measurement (sensing) for recognizing surroundings of the sound collection system 11, in particular, an ambient environment of the microphone capsule 25, that is, an environment in which sounds are collected by the sound collection system 11, and supplies a measurement result to the optimum form determination unit 22.

Specifically, for example, the environment sensor 21 includes a camera (image sensor) that captures the surroundings as an object, a microphone that measures an ambient noise level and the like, a wind speed meter, a rain gauge, a dust concentration meter, a thermometer, a hygrometer, and the like.

The environment sensor 21 measures (detects) wind speed, presence/absence of raindrops, noise level, rainfall, dust concentration, temperature, humidity, and the like as information indicating a state of the ambient environment, and supplies measurement results to the optimum form determination unit 22.

The optimum form determination unit 22 recognizes the state of the ambient environment (hereinafter also referred to as environmental state) of the sound collection system 11 on the basis of the measurement result supplied from the environment sensor 21. For example, the optimum form determination unit 22 can obtain the wind speed and detect the presence or absence of raindrops, the weather, and the like on the basis of an image captured by the camera as the environment sensor 21.

The optimum form determination unit 22 determines an optimum form of the variable microphone shelter 24 by performing calculations or the like as appropriate on the basis of the recognition result of the environmental state.

Here, the optimum form of the variable microphone shelter 24 is determined on the basis of, for example, at least one of the ambient wind speed, presence or absence of raindrops, noise level, rainfall, dust concentration, temperature, humidity, or weather as the environmental state.

The optimum form determination unit 22 supplies optimum form information indicating the determination result of the optimum form of the variable microphone shelter 24 to the shelter optimization control unit 23.

Note that, in recognizing the environmental state, the optimum form determination unit 22 may obtain weather information indicating the weather of an area where the sound collection system 11 is installed from a server or the like via the network, and recognize the environmental state using the weather information.

The shelter optimization control unit 23 controls the variable microphone shelter 24 such that the form of the variable microphone shelter 24 becomes the optimum form, that is, a form indicated by the optimum form information, on the basis of the optimum form information supplied from the optimum form determination unit 22. Furthermore, the shelter optimization control unit 23 supplies the optimum form information to the signal optimization processing unit 26.

The variable microphone shelter 24 includes the plurality of microphone shelters 41 that can be arranged so as to cover the microphone capsule 25, a storage unit for storing the microphone shelters 41, and the like.

The plurality of microphone shelters 41 constituting the variable microphone shelter 24 is different from each other in shape, structure, material, characteristics, and the like. Here, the characteristics of the microphone shelter 41 include, for example, air permeability and acoustic characteristics added to the sound passing through the microphone shelter 41.

The variable microphone shelter 24 allows the form of the microphone shelter 41 covering the microphone capsule 25 to be changed according to the control of the shelter optimization control unit 23.

In other words, the variable microphone shelter 24 allows the form of the microphone shelter 41 covering the microphone capsule 25 to be changed according to the ambient environment (environmental state).

Specifically, for example, in the variable microphone shelter 24, the microphone shelters 41 are switched such that an unnecessary microphone shelter 41 is stored in the storage unit and a necessary microphone shelter 41 is pulled out from the storage unit so as to cover the microphone capsule 25.

That is, the variable microphone shelter 24 causes the form to be changed by switching the microphone shelters 41 that cover the microphone capsule 25 such that the microphone capsule 25 is covered in layers with one or more microphone shelters 41 of the plurality of microphone shelters 41.

Furthermore, for example, the variable microphone shelter 24 allows its own form to be changed by changing the shape or orientation of the microphone shelter 41 that covers the microphone capsule 25, as appropriate.

Note that in the variable microphone shelter 24, the microphone capsule 25 may be covered with one microphone 41, or a plurality of the microphone shelters 41 may be combined and the microphone capsule 25 may be covered in layers with the plurality of microphone shelters 41.

As described above, the variable microphone shelter 24 has a layering structure (multilayer structure) in which the microphone capsule 25 is covered in layers with the plurality of microphone shelters 41 as appropriate.

In other words, the variable microphone shelter 24 has a structure in which each microphone shelter 41 can be independently attached to and detached from the microphone capsule 25 (microphone housing).

The microphone capsule 25 is a microphone that functions as a sound collection unit that collects an ambient sound, and supplies a sound collection signal obtained by the sound collection to the signal optimization processing unit 26.

Note that, in this example, the microphone capsule 25 is used for collecting the ambient sound for telepresence but may be used for measuring the wind speed. In such a case, the microphone capsule 25 measures an ambient sound, more specifically, a wind pressure of ambient wind, and supplies a resultant signal to the signal optimization processing unit 26 as a sound collection signal.

The signal optimization processing unit 26 performs optimization processing for the sound collection signal supplied from the microphone capsule 25 on the basis of the optimum form information supplied from the shelter optimization control unit 23, and supplies a resultant sound collection signal to the telepresence device input unit 27. In other words, the signal optimization processing unit 26 performs the optimization processing according to the environmental state.

For example, the optimization process performed by the signal optimization processing unit 26 is processing for improving the sound quality based on the sound collection signal, that is, signal processing for improving the sound quality. Note that the signal optimization processing unit 26 may perform the optimization processing on the basis of the recognition result of the environmental state.

The telepresence device input unit 27 inputs the sound collection signal supplied from the signal optimization processing unit 26 to a telepresence device (not illustrated) to which the sound collection system 11 is connected.

In the sound collection system 11, the form of the variable microphone shelter 24 that covers the microphone capsule 25 is changed according to the environmental state such as the ambient weather, wind and rain, or dust. Therefore, high-quality sound collection can be performed even in an outdoor environment.

For example, in stationary outdoor sound collection work, high-quality sounds can be continuously recorded without being affected by wind and rain, or dust, including extreme situations such as typhoons, without the need for specialized sound personnel to take care of the work on a constant basis.

Moreover, in the sound collection system 11, the optimization processing according to the form of the variable microphone shelter 24 (microphone shelter 41) that covers the microphone capsule 25, that is, according to the environmental state is applied to the sound collection signal. Therefore, higher-quality sound collection signal can be obtained.

Here, each unit of the sound collection system 11 will be described in more detail.

For example, the housing of the microphone as the microphone capsule 25 (hereinafter also referred to as microphone housing) is a housing having a frame structure for which know-how of an outdoor tent design is used and wind resistance and noise suppression are taken into consideration.

Then, the microphone shelters 41 are arranged so as to cover the microphone capsule 25 outside and inside a frame constituting the microphone housing.

In this case, the shape of the microphone housing, that is, the shape of the entire frame can be made into an omnidirectional fluid shape (streamlined shape) so that the wind resistance is lowered and noise such as wind is suppressed. Note that the microphone housing may have a monocoque structure.

Furthermore, the microphone housing may have a structure in which the direction of the microphone housing is changed (rotated) due to force of wind when the variable microphone shelter 24 is exposed to wind.

In addition, in a case where the microphone shelter 41 is a curtain body, when the microphone shelter 41 receives wind, the frame of the microphone housing may be squeaked, and squeak sound may be collected by the microphone capsule 25.

Therefore, to suppress generation of such a squeak sound, the entire frame of the microphone housing, in particular, a joint portion between frames or the like may be coated with a material such as silicon that does not easily generate a sound.

Furthermore, the microphone shelter 41 may be configured using a curtain body, a surface material of the microphone shelter 41 may be a high-density synthetic fiber material, and a back surface of the synthetic fiber material may be subjected to silent coating. The silent coating is used for hunting, for example, and has an effect of reducing crisp sound generated by the synthetic fiber material (silencing effect).

By using the microphone shelter 41 to which such silent coating process is applied, noise caused by raindrops or the like in rainy weather can be reduced, for example. Moreover, for example, the microphone shelter 41 may be prepared for each weather.

For example, as the microphone shelter 41 for fine weather, a microphone shelter formed using a material having air permeability such as a mesh material or ultra-thin georgette, in particular, a material having a higher air permeability than other microphone shelters 41 may be prepared.

By doing so, sufficient air permeability can be ensured. As a result, the influence of muffled sound in the microphone capsule 25 can be suppressed, for example, and high-quality sound collection can be performed.

Further, for example, as the microphone shelter 41 for rainy weather, a microphone shelter formed using a water-repellent or waterproof material may be prepared.

In the case where the sound collection system 11 is used outdoors, the material of the microphone shelter 41, which is placed on the outermost side and covers the microphone capsule 25, may be required not to allow piles of the material to lie down even when it gets wet, not to stain with water, and not to mold from the viewpoint of weather resistance.

Therefore, for example, the microphone shelter 41 for rainy weather formed using the water-repellent or waterproof material is prepared, and the microphone shelter 41 is placed on the outermost side (outer shell) of the variable microphone shelter 24 in rainy weather, so that the weather resistance can be improved.

Moreover, as the microphone shelter 41 that covers the core of the microphone capsule 25 that is a sound collecting device, that is, as the microphone shelter 41 for core arranged on the innermost side (the side of the microphone capsule 25), a microphone shelter formed using a highly dense and hairy material using ultrafine fiber such as puff and fleece may be prepared.

By using such a microphone shelter 41 for core, the silencing effect for the rain sound and wind sound is exerted, and the noise such as the rain sound and wind sound included in the sound collection signal can be reduced.

By automatically combining appropriate ones of the above-described plurality of microphone shelters 41 for fine weather, rainy weather, core, and the like according to the environmental state, a shielding structure having a multilayer structure such as a tent can be formed using the optimum material configuration, and can cover the microphone capsule 25. As a result, the weather resistance and wind resistance can be improved, and sufficiently high-quality sound collection signal can be obtained.

For example, the optimum form of the variable microphone shelter 24 is determined according to the recognition result of the environmental state, such as rainy weather but weak wind, fine weather but strong wind, high humidity and dew condensation, and the form of the variable microphone shelter 24 is changed on the basis of the optimum form information according to the determination result.

Specifically, for example, in the case where the weather is fine but the wind is strong, the variable microphone shelter 24 has the form that the microphone capsule 25 is covered with the microphone shelters 41 for fine weather and core.

As described above, in the sound collection system 11, the environment sensor 21 recognizes the ambient environmental state such as the wind speed, rainfall, dust concentration, humidity, temperature, noise level, or weather for the microphone housing.

Then, the form (control parameters) having the best balance between the weather resistance and wind resistance, and the sound quality is determined by calculation or the like within a range where the form change of the variable microphone shelter 24 is possible on the basis of the recognition result of the environmental state, and control for changing the form of the variable microphone shelter 24 is performed. By doing so, the high-quality sound collection can be performed on a constant basis even outdoors.

Furthermore, in the sound collection system 11, an airflow does not directly hit a diaphragm by providing the variable microphone shelter 24, unlike a general recording microphone, so the high-quality sound collection signal with less noise can be obtained.

In particular, by adopting a streamlined shape that is highly resistant to wind noise as the shape of the microphone shelter 41, an acoustic signal can be detected while the wind flows through the microphone shelter 41 (microphone housing), like a lateral line of fish. As a result, stable sound collection can be performed even in a strong wind environment.

Furthermore, the sound collection system 11 is sometimes installed inside a shielding structure such as a tent set up outdoors. In such a case, the tent design and the cloth material can be devised from the viewpoint of soundproofing and sound insulation. Moreover, for example, the tent itself can be used as the microphone shelter 41.

Specifically, for example, regarding the tent design, a streamlined shape that does not receive wind resistance can be formed similarly to the above-described microphone shelter 41.

Furthermore, it is conceivable to have a structure having high wind resistance such as two or more frames intersecting with (crossing) each other, as the framework of the tent.

Alternatively, a frame part of the tent may have a single frame structure or a foldable monocoque structure, having a certain degree of wind resistance, having no part where the frames intersect with each other, and having no squeak noise when receiving wind resistance, that is, with less noise, for example.

Moreover, the material of the tent, in particular, the material of the outer shell part such as a fly sheet part of the tent may be formed using a similar material to the case of the microphone shelter 41.

That is, for example, if a tent material that is too dense and has a firm feel is used, a crisp sound will be produced. Therefore, it is conceivable to use a synthetic fiber material having certain density with a back surface subjected to silent coating. As a result, a tent that is supple and less likely to generate noise can be obtained.

Furthermore, a tent may have a multilayer structure as in the case of the microphone shelter 41, and a fly sheet for fine weather or rainy weather that covers the entire tent may be prepared.

In such cases, for example, it is conceivable to form the fly sheet for fine weather using a material having air permeability such as a mesh material or an ultra-thin georgette, and the fly sheet for rainy weather using a water-repellent or waterproof material.

Furthermore, the optimization processing performed for the sound collection signal by the signal optimization processing unit 26 may be performed on the basis of the optimum form information, as described above, or may be performed on the basis of the recognition result of the environmental state.

For example, correction processing considering acoustic characteristics and resonance frequency inside the variable microphone shelter 24 and the like is performed as the optimization processing, according to the structure of the variable microphone shelter 24 (microphone housing), that is, the form or mode of the variable microphone shelter 24. The correction processing referred to here is, for example, the equalizer processing or filter processing.

As a specific example of the optimization processing, the equalizer processing of attenuating the gain of the frequency band of the noise sound of the wind supposed to be largely included in the sound collection signal (gain adjustment for correcting the frequency characteristics) according to the wind speed estimated from the form indicated by the optimum form information or the wind speed obtained as the recognition result of the environmental state, or the like is conceivable.

By performing the optimization processing according to the optimum form information and the recognition result of the environmental state in this manner, the high-quality sound collection signal can be obtained regardless of the form of the variable microphone shelter 24 and the ambient environment. Therefore, natural environmental sounds can be constantly and continuously obtained without making a user aware of changes in the form of the variable microphone shelter 24.

The sound collection system 11 operates so that the optimum sound connection can be continuously performed by autonomously recognizing the environmental condition (environmental state), like a robot microphone, changing the form of the variable microphone shelter 24 on the basis of the recognition result, and performing the optimization processing.

Furthermore, in the sound collection system 11, the form change of the variable microphone shelter 24 and the control of the optimization processing are performed such that the sound of the entire environment is simply, omnidirectionally, and flatly collected, rather than focusing on a specific sound source such as the sound of a bird or the sound of a waterfall to increase the directivity or using an equalizer. In this case, the position of each sound source is three-dimensionally estimated and used as information.

Moreover, for example, the sound collection system 11 can collect sound that is not limited to a physical dynamic range of the diaphragm, using a laser microphone (camera) that captures vibration of air by a laser beam.

Note that, in the sound collection system 11, the anemometer may be used as the environment sensor 21, or the microphone capsule 25 may be used as the anemometer. For example, as the anemometers, thermal anemometers such as Anemomaster anemometers, impeller (vane) anemometers, ultrasonic anemometers, and pitot tube anemometers are known, and any of them can be used as the environment sensor 21 or the microphone capsule 25.

Description of Sound Collection Processing

Figure 2:
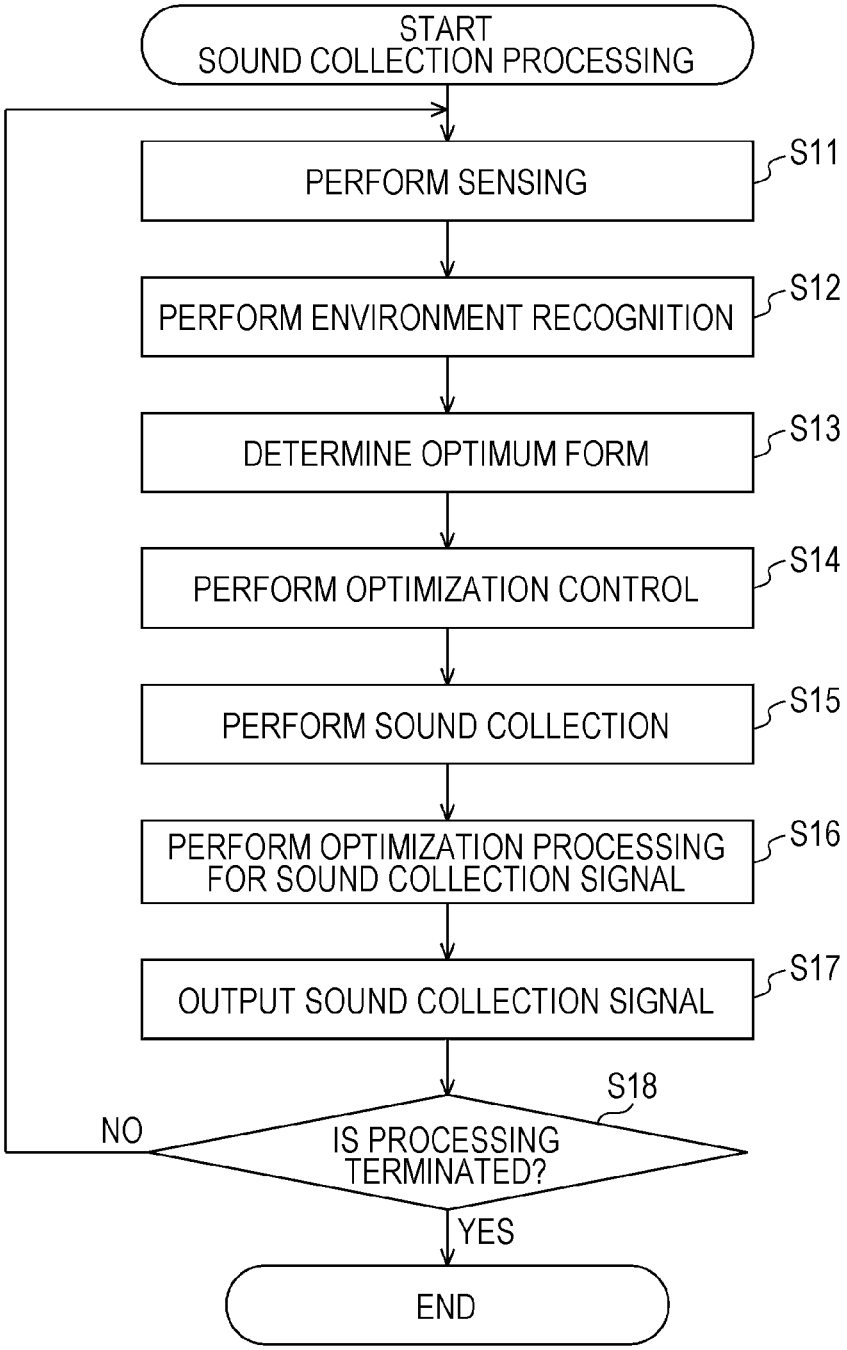
FIG. 2 is a flowchart for describing sound collection processing.

Next, an operation of the sound collection system 11 described above will be described. That is, hereinafter, the sound collection processing by the sound collection system 11 will be described with reference to the flowchart in FIG. 2.

In step S11, the environment sensor 21 performs sensing, that is, measures the ambient environment, and supplies the measurement result to the optimum form determination unit 22.

In step S12, the optimum form determination unit 22 recognizes the environment on the basis of the measurement result supplied from the environment sensor 21. That is, the optimum form determination unit 22 recognizes the environmental state around the sound collection system 11.

For example, in step S12, the weather, rainfall, wind speed, and the like as the ambient environmental state are recognized on the basis of the image captured by the camera, the measurement result by the rain gauge, and the measurement result by the wind speed meter, as the environment sensor 21.

In step S13, the optimum form determination unit 22 determines the optimum form of the variable microphone shelter 24 on the basis of the recognition result of the environmental state obtained in the processing in step S12, and supplies the optimum form information indicating the determination result to the shelter optimization control unit 23.

In step S14, the shelter optimization control unit 23 performs optimization control for the variable microphone shelter 24 on the basis of the optimum form information supplied from the optimum form determination unit 22, and supplies the optimum form information to the signal optimization processing unit 26.

That is, the shelter optimization control unit 23 changes the variable microphone shelter 24 into the form indicated by the optimum form information.

The form of the variable microphone shelter 24 is changed such that only specific one or plurality of microphone shelters 41 covers the microphone capsule 25 by pulling out a specific microphone shelter 41 from the storage unit or storing an unnecessary microphone shelter 41 to the storage unit according to the control of the shelter optimization control unit 23.

Furthermore, for example, the variable microphone shelter 24 allows the form to be changed by changing the shape of the microphone shelters 41 (microphone housing) or changing the orientation of the variable microphone shelter 24 itself (microphone shelters 41) as appropriate according to the control of the shelter optimization control unit 23.

In step S15, the microphone capsule 25 collects sound, and supplies the resultant sound collection signal to the signal optimization processing unit 26.

In step S16, the signal optimization processing unit 26 performs the optimization processing for the sound collection signal supplied from the microphone capsule 25 on the basis of the optimum form information supplied from the shelter optimization control unit 23, and supplies the resultant sound collection signal to the telepresence device input unit 27.

For example, in the optimization processing, the gain adjustment (equalizer processing) for amplifying or attenuating a frequency component according to the form of the variable microphone shelter 24 indicated by the optimum form information is performed for the sound collection signal.

In step S17, the telepresence device input unit 27 outputs the sound collection signal supplied from the signal optimization processing unit 26 to the telepresence device.

For example, the telepresence device transmits the sound collection signal supplied from the telepresence device input unit 27 and a video signal of a separately obtained video to another telepresence device via the network.

In step S18, the sound collection system 11 determines whether or not to terminate the sound collecting processing.

In a case where it is determined in step S18 that the sound collection processing is not yet terminated, the processing returns to step S11 and the above-described processing is repeatedly performed.

On the other hand, in a case where it is determined in step S18 that the sound collection processing is terminated, each unit of the sound collection system 11 stops the operation and the sound collection processing is terminated.

As described above, the sound collection system 11 recognizes the environmental state around the system, changes the form of the variable microphone shelter 24 to the optimum form for the environmental state according to the recognition result, and performs the optimization processing for the sound collection signal. By doing so, high-quality sound collection can be performed even in an outdoor environment.

Configuration Example of Computer

By the way, the above-described series of processing can be executed by hardware or software. In the case of executing the series of processing by software, a program that configures the software is installed in a computer. Here, examples of the computer include a computer incorporated in dedicated hardware, and a general-purpose personal computer or the like capable of executing various functions by installing various programs, for example.

Figure 3:
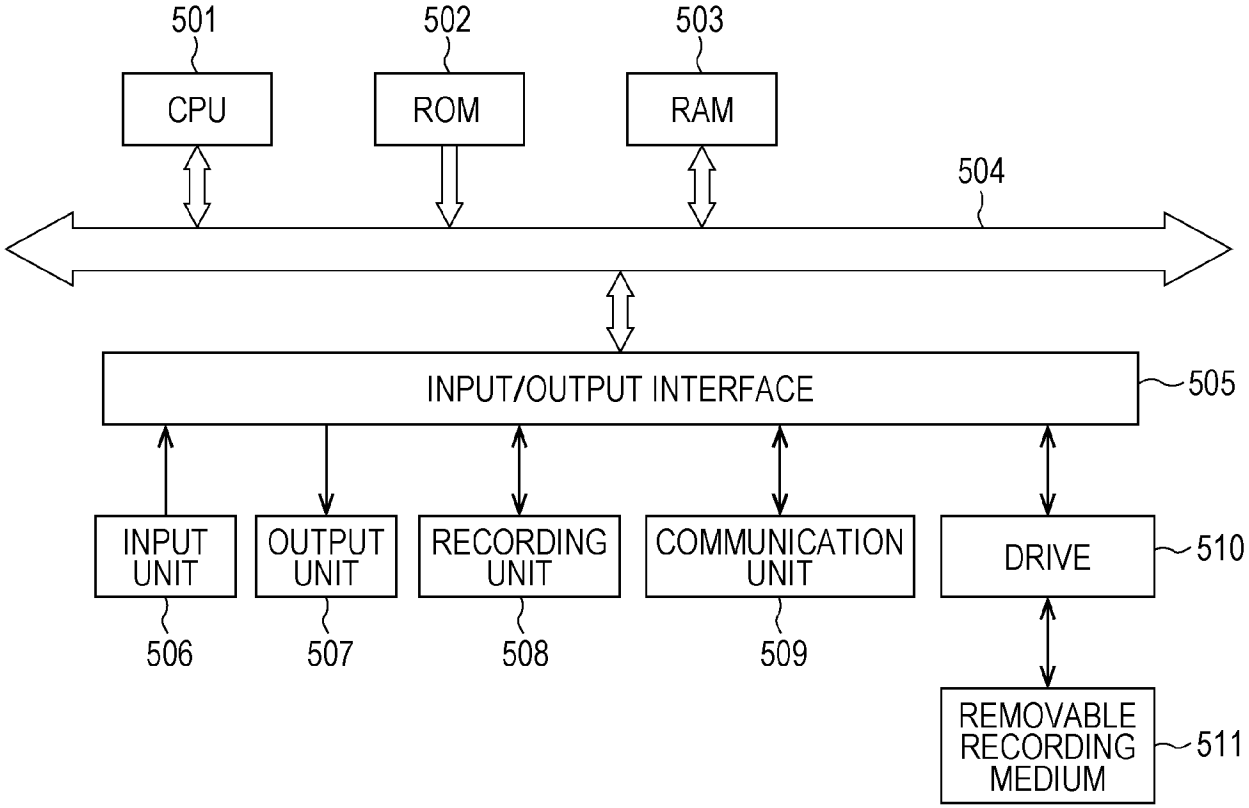
FIG. 3 is a diagram illustrating a configuration example of a computer.

FIG. 3 is a block diagram illustrating a configuration example of hardware of a computer that executes the above-described series of processing by a program.

In a computer, a central processing unit (CPU) 501, a read only memory (ROM) 502, and a random access memory (RAM) 503 are mutually connected by a bus 504.

Moreover, an input/output interface 505 is connected to the bus 504. An input unit 506, an output unit 507, a recording unit 508, a communication unit 509, and a drive 510 are connected to the input/output interface 505.

The input unit 506 includes a keyboard, a mouse, a microphone, an image sensor, an anemometer, a thermometer, a hygrometer, and the like. The output unit 507 includes a display, a speaker, and the like. The recording unit 508 includes a hard disk, a nonvolatile memory, and the like. The communication unit 509 includes a network interface and the like. The drive 510 drives a removable recording medium 511 such as a magnetic disk, an optical disk, a magneto-optical disk, or a semiconductor memory.

In the computer configured as described above, the CPU 501 loads a program recorded in the recording unit 508 into the RAM 503, for example, and executes the program via the input/output interface 505 and the bus 504, thereby performing the above-described series of processing.

The program to be executed by the computer (CPU 501) can be recorded on the removable recording medium 511 as a package medium or the like, for example, and provided. Furthermore, the program can be provided via a wired or wireless transmission medium such as a local area network, the Internet, or digital satellite broadcast.

In the computer, the program can be installed to the recording unit 508 via the input/output interface 505 by attaching the removable recording medium 511 to the drive 510. Furthermore, the program can be received by the communication unit 509 via a wired or wireless transmission medium and installed in the recording unit 508. Other than the above method, the program can be installed in the ROM 502 or the recording unit 508 in advance.

Note that the program executed by the computer may be a program processed in chronological order according to the order described in the present specification or may be a program executed in parallel or at necessary timing such as when a call is made.

Furthermore, embodiments of the present technology are not limited to the above-described embodiments, and various modifications can be made without departing from the gist of the present technology.

For example, in the present technology, a configuration of cloud computing in which one function is shared and processed in cooperation by a plurality of devices via a network can be adopted.

Furthermore, the steps described in the above-described flowcharts can be executed by one device or can be shared and executed by a plurality of devices.

Moreover, in the case where a plurality of processes is included in one step, the plurality of processes included in the one step can be executed by one device or can be shared and executed by a plurality of devices.

Moreover, the present technology may be configured as follows.

(1)

A sound collection system including:

a sound collection unit;

a variable shelter configured to cover the sound collection unit;

an optimum form determination unit configured to determine a form of the variable shelter on the basis of an ambient environmental state; and a shelter optimization control unit configured to change the form of the variable shelter on the basis of a determination result by the optimum form determination unit.

(2)

The sound collection system according to (1), in which the variable shelter includes a plurality of shelters, and the form is changed by switching the shelters that cover the sound collection unit such that the sound collection unit is covered by one or a plurality of the shelters of the plurality of the shelters.

(3)

The sound collection system according to (2), in which the plurality of the shelters is different from one another in shape, structure, material, or characteristic.

(4)

The sound collection system according to (2) or (3), in which the shelter has a streamlined shape.

(5)

The sound collection system according to any one of (1) to (4), in which the form of the variable shelter is changed by changing a shape.

(6)

The sound collection system according to any one of (1) to (5), in which the form of the variable shelter is changed by changing an orientation of the variable shelter.

(7)

The sound collection system according to any one of (1) to (6), in which the optimum form determination unit determines the form of the variable shelter on the basis of at least one of ambient weather, wind speed, rainfall, presence or absence of raindrops, dust concentration, temperature, humidity, or noise level, as the environmental state.

(8)

The sound collection system according to any one of (1) to (7), further including:

a signal optimization processing unit configured to perform signal processing according to the form of the variable shelter or the environmental state, for a sound collection signal obtained by the sound collection unit.

(9)

The sound collection system according to (8), in which the signal processing is equalizer processing or filter processing.

(10)

A sound collection method by a sound collection system including a sound collection unit, and a variable shelter that covers the sound collection unit, the sound collection method including:

determining a form of the variable shelter on the basis of an ambient environmental state; and changing the form of the variable shelter on the basis of a determination result of the form of the variable shelter.

(11)

A program for causing a computer that controls a sound collection system including a sound collection unit, and a variable shelter that covers the sound collection unit to execute processing of:

determining a form of the variable shelter on the basis of an ambient environmental state; and changing the form of the variable shelter on the basis of a determination result of the form of the variable shelter.

(12)

A variable microphone shelter including:

a plurality of shelters, in which the shelters that cover a sound collection unit are switched such that the sound collection unit is covered with one or a plurality of the shelters of the plurality of the shelters according to an ambient environmental state.

(13)

The variable microphone shelter according to (12), in which the plurality of the shelters is different from one another in shape, structure, material, or characteristic.

(14)

The variable microphone shelter according to (12) or (13), in which the shelter has a streamlined shape.

(15)

The variable microphone shelter according to any one of (12) to (14), in which a shape of the shelter that covers the sound collection unit is changed according to the environmental state.

(16)

The variable microphone shelter according to any one of (12) to (15), in which a direction of the shelter that covers the sound collection unit is changed according to the environmental state.

(17)

The variable microphone shelter according to any one of (12) to (16), in which the environmental state is at least one of ambient weather, wind speed, rainfall, presence or absence of raindrops, dust concentration, temperature, humidity, or noise level.

It should be understood by those skilled in the art that various modifications, combinations, sub-combinations and alterations may occur depending on design requirements and other factors insofar as they are within the scope of the appended claims or the equivalents thereof.

REFERENCE SIGNS LIST

11 Sound collection system
21 Environment sensor
22 Optimum form determination unit
23 Shelter optimization control unit
24 Variable microphone shelter
25 Microphone capsule
26 Signal optimization processing unit
41-1, 41-2, 41 Microphone shelter

The invention claimed is:

1. A sound collection system, comprising:

a sound collection device;

a variable shelter device including different shelters that are individually movable between covering and not covering the sound collection device; and processing circuitry configured to:

determine an optimum form of the variable shelter device on a basis of an ambient environmental state of surroundings of the sound collection device, the optimum form of the variable shelter device corresponding to the sound collection device being covered by a subset of the shelters; and configure a form of the variable shelter device on a basis of the determined optimum form.

2. The sound collection system according to claim 1, wherein the shelters are different from one another in shape, structure, material, or characteristic.

3. The sound collection system according to claim 1, wherein at least one shelter of the shelters has a streamlined shape that is wide in a middle and tapers toward two ends thereof.

4. The sound collection system according to claim 1, wherein the form of the variable shelter device is changeable by changing a shape of at least one shelter of the shelters.

5. The sound collection system according to claim 1, wherein the form of the variable shelter device is changeable by changing an orientation of the variable shelter device.

6. The sound collection system according to claim 1, wherein the processing circuitry is configured to determine the form of the variable shelter device on a basis of at least one of ambient weather, wind speed, rainfall, presence or absence of raindrops, dust concentration, temperature, humidity, or noise level, as the ambient environmental state.

7. The sound collection system according to claim 1, wherein the processing circuitry is further configured to perform signal processing according to the form of the variable shelter vi or the ambient environmental state, for a sound collection signal obtained by the sound collection device.

8. The sound collection system according to claim 7, wherein the signal processing is equalizer processing or filter processing.

9. A method for a sound collection system, comprising:

determining, by processing circuitry of the sound collection system, an optimum form of a variable shelter device of the sound collection system on a basis of an ambient environmental state of surroundings of a sound collection device of the sound collection system, the variable shelter device including different shelters that are individually movable between covering and not covering the sound collection device, and the optimum form of the variable shelter device corresponding to the sound collection device being covered by a subset of the shelters; and configuring a form of the variable shelter device on a basis of the determined optimum form.

10. A non-transitory computer-readable storage medium storing a computer program, which when being executed by processing circuitry of a sound collection system causes the processing circuitry to perform a method comprising:

determining an optimum form of a variable shelter device of the sound collection system on a basis of an ambient environmental state of surroundings of a sound collection device of the sound collection system, the variable shelter device including different shelters that are individually movable between covering and not covering the sound collection device, and the optimum form of the variable shelter device corresponding to the sound collection device being covered by a subset of the shelters; and configuring a form of the variable shelter device on a basis of the determined optimum form.

11. A variable microphone shelter device, comprising:

a storage; and a plurality of different shelters, each shelter of the shelters being movable between a pulled out position configured to cover a sound collection device and a stored position in the storage configured to not cover the sound collection device, wherein the shelters are switched such that the sound collection device is covered with a subset of the shelters that is determined by processing circuitry according to an ambient environmental state of surroundings of the sound collection device.

12. The variable microphone shelter device according to claim 11, wherein the shelters are different from one another in shape, structure, material, or characteristic.

13. The variable microphone shelter device according to claim 11, wherein at least one shelter of the shelters has a streamlined shape that is wide in a middle and tapers toward two ends thereof.

14. The variable microphone shelter device according to claim 11, wherein a shape of at least one shelter of the shelters is changeable according to the ambient environmental state.

15. The variable microphone shelter device according to claim 11, wherein a direction of at least one shelter of the shelters is changeable according to the ambient environmental state.

16. The variable microphone shelter device according to claim 11, wherein the ambient environmental state includes at least one of ambient weather, wind speed, rainfall, presence or absence of raindrops, dust concentration, temperature, humidity, or noise level.

* * * * *